US005186979A

United States Patent [19]

Ballenger, Jr. et al.

[11] Patent Number: 5,186,979

[45] Date of Patent: Feb. 16, 1993

[54] METHOD OF PREVENTION OF ADHESION OF HOT-MIX ASPHALT TO CONTAINERS AND EQUIPMENT

[75] Inventors: William T. Ballenger, Jr., San Benito; Terry J. Light, Sr., Livingston, both of Tex.

[73] Assignee: Asphalt Control Systems Inc., Livingston, Tex.

[21] Appl. No.: 674,182

[22] Filed: Mar. 25, 1991

[51] Int. Cl.[5] ..... B05D 7/22

[52] U.S. Cl. ..... 427/156; 427/154; 427/133; 427/230; 427/233; 427/384; 427/417; 427/421

[58] Field of Search ..... 427/154, 236, 230, 239, 427/133, 384, 417, 421, 135, 156

[56] References Cited

U.S. PATENT DOCUMENTS

| | | | |
|---|---|---|---|
| 2,015,290 | 9/1935 | Sanders | 427/239 |
| 2,047,385 | 7/1936 | Sanders | 427/239 |
| 4,312,901 | 1/1982 | Kekish et al. | 427/239 |
| 4,421,791 | 12/1983 | Kerish et al. | 427/239 |
| 4,425,381 | 1/1984 | Walsh | 427/239 |

*Primary Examiner*—Janyce Bell
*Attorney, Agent, or Firm*—Neal J. Mosely

[57] ABSTRACT

An improved method of prevention of adhesion of hot-mix asphalt to dump trucks and other containers or equipment comprises preparing an aqueous dispersion of a vegetable oil and applying the dispersion to the surface of the container before loading the hot-mix asphalt therein. Vegetable oils which are useful as release agents in aqeous dispersion include cottonseed oil, soya oil, rate (canola) oil, peanut oil, corn oil, sunflower oil, palm oil, coconut oil, and palm kernel oil. The oil is emulsified in water, using a suitable emulsifier, preferably a sorbitol base emulsifier, in the amount of 1–5 oz. per gallon of water. The oil and emulsifier are preferably premixed and supplied as a self-emulsifier composition. The resulting emulsion is applied in an amount to provide a thin coating on the wall of the container or equipment. The emulsion is applied in the amount of 3–4 qts. to coat a dump truck or 4–6 qts. to coat a trailer. The hot-mix asphalt is easily removed from the container, i.e., truck or trailer, or other equipment without sticking and the release agent has been found to be completely biodegradable.

14 Claims, No Drawings

METHOD OF PREVENTION OF ADHESION OF HOT-MIX ASPHALT TO CONTAINERS AND EQUIPMENT

BACKGROUND OF THE INVENTION

1. FIELD OF THE INVENTION

This invention relates generally to release agents and methods of releasing products from containers and more particularly to an improved biodegradable release agent for hot-mix asphalt and methods including the application of such release agents to coat the container or other equipment for the hot-mix asphalt.

2. BRIEF DESCRIPTION OF THE PRIOR ART

In the transporting and handling of hot-mix asphalt, it has been necessary to treat the dump truck or trailer with a suitable release agent to prevent the asphalt-mix from sticking to the walls thereof Petroleum oils have been used to coat the walls of trucks or trailers for this purpose. Recently, the use of petroleum oils as release agents has been criticized and, in some places, prohibited because of environmental concerns. Consequently, the industry has had a need for an environmentally acceptable release agent for dump trucks and trailers for transporting hot-mix asphalt.

There are several patents which illustrate the need for release agents in different applications.

Aron U.S. Pat. No. 3,437,621 discloses a composition comprising an oleate salt of a metal, a potassium salt of a fatty acid, a fatty acid, a polyethylene glycol ester or ether, an alkylglycol, or a derivative thereof, a high molecular weight alkylol, and a paraffin which is used as a mill release agent for rubber bases.

Kekish U.S. Pat. No. 4,312,901 discloses a method for reducing the tendency of coal to freeze and thus adhere to the sides of metal storage and shipping containers used to store and/or transport coal at temperatures below the freezing point of water which comprises applying to the sides of the container a coating composition comprising a hydrocarbon liquid and a hydrocarbon oil-soluble liquid having an HLB value of 1-8.

Blahak U.S. Pat. No. 4,312,672 discloses a release agent applied to the surface of a mold to permit ready removal of plastic, particularly polyurethane, from the mold. The release agent contains a film-forming substance having an affinity to the plastic and becomes attached to the plastic and is removed therewith on removal from the mold.

Dwivedy U.S. Pat. No. 4,898,751 discloses methods and compositions of matter (e.g., mineral or vegetable waxes) for inhibiting and/or preventing the formulation of adhesion of materials such as coal, mineral ores, taconite, glass and others to the container (railcars, silo, hopper bins, etc.) walls due to freezing temperatures in winter and/or excessive moistures during the rest of the year.

The present invention is distinguished over the prior art in general, and these patents in particular by providing an improved method of prevention of adhesion of hot-mix asphalt to dump trucks and other containers or equipment which comprises preparing an aqueous dispersion of a vegetable oil and applying the dispersion to the surface of the container before loading the hot-mix asphalt therein. Vegetable oils which are useful as release agents in aqueous dispersion include cottonseed oil, soya oil, rate (canola) oil, peanut oil, corn oil, sunflower oil, palm oil, coconut oil, and palm kernel oil. The oil is emulsified in water, using a suitable emulsifier, preferably a sorbitol base emulsifier, in the amount of 1-5 oz. per gallon of water. The oil and emulsifier are preferably premixed and supplied as a self-emulsifiable composition. The resulting emulsion is applied in an amount to provide a thin coating on the wall of the container. The emulsion is applied in the amount of 3-4 qts. to coat a dump truck or 4-6 qts. to coat a trailer. The hot-mix asphalt is easily removed from the container, i.e., truck or trailer, or other equipment without sticking and the release agent has been found to be completely biodegradable.

SUMMARY OF THE INVENTION

It is therefore an object of the present invention to provide a new and improved method for preventing adhesion of hot-mix asphalt to dump trucks and other containers or equipment.

It is another object of this invention is to provide a new and improved method for preventing adhesion of hot-mix asphalt to dump trucks and other containers or equipment which uses a release agent which is biodegradable.

Another object of this invention is to provide a new and improved method for preventing adhesion of hot-mix asphalt to dump trucks and other containers or equipment which uses release agents which are inexpensive and easy to apply.

Another object of this invention is to provide a new and improved method for preventing adhesion of hot-mix asphalt to dump trucks and other containers or equipment which uses release agents which are inexpensive and easy to apply are biodegradable.

Still another object of this invention is to provide a new and improved method for preventing adhesion of hot-mix asphalt to dump trucks and other containers or equipment which uses release agents applied as aqueous dispersions or emulsions.

Still another object of this invention is to provide a new and improved method for preventing adhesion of hot-mix asphalt to dump trucks and other containers or equipment which uses biodegradable release agents applied as aqueous dispersions or emulsions.

A further object of this invention is to provide an improved method for preventing adhesion of hot-mix asphalt to dump trucks and other containers or equipment which uses biodegradable release agents, comprising vegetable oils, applied as aqueous dispersions or emulsions.

A further object of this invention is to provide a new and improved release agent for preventing adhesion of hot-mix asphalt to dump trucks and other containers or equipment.

Other objects of the invention will become apparent from time to time throughout the specification and claims as hereinafter related.

The above noted objects and other objects of the invention are accomplished by a novel improved method of prevention of adhesion of hot-mix asphalt to dump trucks and other containers or equipment which comprises preparing an aqueous dispersion of a vegetable oil and applying the dispersion to the surface of the container before loading the hot-mix asphalt therein. Vegetable oils which are useful as release agents in aqueous dispersion include cottonseed oil, soya oil, rate (canola) oil, peanut oil, corn oil, sunflower oil, palm oil, coconut oil, and palm kernel oil. The oil is emulsified in water, using a suitable emulsifier, preferably a sorbitol base emulsifier, in the amount of 1-5 oz. per gallon of water. The oil and emulsifier are preferably premixed and supplied as a self-emulsifiable composition. The resulting emulsion is applied in an amount to provide a thin coating on the wall of the container. The emulsion is applied in the amount of 3-4 qts. to coat a dump truck or 4-6 qts. to coat a trailer. The hot-mix asphalt is easily removed from the container, i.e., truck or trailer, or other equipment without sticking and the release agent has been found to be completely biodegradable.

DESCRIPTION OF THE PREFERRED EMBODIMENT

The present invention is directed to novel compositions and more particularly to methods of use of such compositions for inhibiting and/or preventing the adhesion of hot-mix asphalt to containers or equipment, such as dump trucks, trailers, etc. The invention utilizes environmentally acceptable materials which functions as release agents for hot-mix asphalt when applied as a coating to the walls of such containers or equipment.

The benefits of the invention are obtained by applying the novel release agents, as by spraying, as a thin film or coating to the walls of the container. The invention is useful in storage and transportation of hot-mix asphalt which would otherwise adhere to the walls of the container or equipment.

The novel compositions of this invention comprise dilute dispersions or emulsions in water of vegetable oils. The vegetable oils include cottonseed oil, soya oil, rate (canola) oil, peanut oil, corn oil, sunflower oil, palm oil, coconut oil, and palm kernel oil. The vegetable oils are supplied in admixture with a known emulsifier. Sorbitol derivatives are particularly useful as emulsifiers, although any emulsifier known to facilitate dispersion or emulsion of vegetable oils may be used. The amount of emulsifier mixed in with the vegetable oil is an amount sufficient for the vegetable oil to disperse readily in water. The vegetable oil-emulsifier mixture is added to water in the amount of 1-5 oz. per gallon of water and the resulting .emulsion sprayed on the walls of a container at a rate of 3-4 qts. for a dump truck or 4-6 qts. for a trailer. Examples of the use of this release agent are set forth below.

EXAMPLE 1

Cottonseed oil was admixed with sufficient sorbitol based emulsifier to produce a self emulsifying mixture. Then, the mixture was mixed with water in the proportion of 1-5 oz. (preferably 2-3 oz.) of the mixture per gallon of water to yield a treating emulsion for application to the walls of containers or equipment such as dump trucks and trailers. The treating emulsion was applied by spraying uniformly on the walls or a dump truck or trailer in the amount of 3-4 qts. per dump truck or 4-6 qts. per trailer. The amount varies somewhat according to the size of the container but can be determined readily by observation.

The dump truck or trailer coated with the treating emulsion was filled with hot-mix asphalt and emptied at the point of use with no adhesion to the walls of the container. The coating emulsions used in this method of treatment are completely biodegradable and meet environmental requirements. A like effect is observed when other equipment, tools, implements, etc. are coated with the treating emulsion, i.e. the equipment, tools, implements, etc. are easily released therefrom.

EXAMPLE 2

Soya oil is admixed with sufficient sorbitol based emulsifier to produce a self emulsifying mixture. Then, the mixture is mixed with water in the proportion of 2-3 oz. of the mixture per gallon of water to yield a treating emulsion for application to the walls of containers or equipment such as dump trucks and trailers. The treating emulsion is applied by spraying uniformly on the walls or a dump truck or trailer in the amount of 3-4 qts. per dump truck or 4-6 qts. per trailer. The amount varies somewhat according to the size of the container but can be determined readily by observation.

The dump truck or trailer coated with the treating emulsion is filled with hot-mix asphalt and emptied at the point of use with no adhesion to the walls of the container. The coating emulsions used in this method of treatment are completely biodegradable and meet environmental requirements. A like effect is observed when other equipment, tools, implements, etc. are coated with the treating emulsion, i.e. the equipment, tools, implements, etc. are easily released therefrom.

EXAMPLE 3

Canola oil is admixed with sufficient sorbitol based emulsifier to produce a self emulsifying mixture. Then, the mixture is mixed with water in the proportion of about 2-3 oz. of the mixture per gallon of water to yield a treating emulsion for application to the walls of containers or equipment such as dump trucks and trailers. The treating emulsion is applied by spraying uniformly on the walls or a dump truck or trailer in the amount of 3-4 qts. per dump truck or 4-6 qts. per trailer. The amount varies somewhat according to the size of the container but can be determined readily by observation.

The dump truck or trailer coated with the treating emulsion is filled with hot-mix asphalt and emptied at the point of use with no adhesion to the walls of the container. The coating emulsions used in this method of treatment are completely biodegradable and meet environmental requirements. A like effect is observed when other equipment, tools, implements, etc. are coated with the treating emulsion, i.e. the equipment, tools, implements, etc. are easily released therefrom.

EXAMPLE 4

Peanut oil is admixed with sufficient sorbitol based emulsifier to produce a self emulsifying mixture. Then, the mixture is mixed with water in the proportion of about 2-3 oz. of the mixture per gallon of water to yield a treating emulsion for application to the walls of containers or equipment such as dump trucks and trailers The treating emulsion is applied by spraying uniformly on the walls or a dump truck or trailer in the amount of 3-4 qts. per dump truck or 4-6 qts. per trailer. The amount varies somewhat according to the size of the container but can be determined readily by observation.

The dump truck or trailer coated with the treating emulsion is filled with hot-mix asphalt and, emptied at the point of use with no adhesion to the walls of the container. The coating emulsions used in this method of treatment are completely biodegradable and meet environmental requirements. A like effect is observed when other equipment, tools, implements, etc. are coated with the treating emulsion, i.e. the equipment, tools, implements, etc. are easily released therefrom.

EXAMPLE 5

Sunflower oil is admixed with sufficient sorbitol based emulsifier to produce a self emulsifying mixture. Then, the mixture is mixed with water in the proportion of about 2–3 oz. of the mixture per gallon of water to yield a treating emulsion for application to the walls of containers or equipment such as dump trucks and trailers. The treating emulsion is applied by spraying uniformly on the walls or a dump truck or trailer in the amount of 3–4 qts. per dump truck or 4–6 qts. per trailer. The amount varies somewhat according to the size of the container but can be determined readily by observation.

The dump truck or trailer coated with the treating emulsion is filled with hot-mix asphalt and emptied at the point of use with no adhesion to the walls of the container. The coating emulsions used in this method of treatment are completely biodegradable and meet environmental requirements. A like effect is observed when other equipment, tools, implements, etc. are coated with the treating emulsion, i.e. the equipment, tools, implements, etc. are easily released therefrom.

EXAMPLE 6

Palm oil is admixed with sufficient sorbitol based emulsifier to produce a self emulsifying mixture. Then, the mixture is mixed with water in the proportion of about 2–3 oz. of the mixture per gallon of water to yield a treating emulsion for application to the walls of containers or equipment such as dump trucks and trailers. The treating emulsion is applied by spraying uniformly on the walls or a dump truck or trailer in the amount of 3–4 qts. per dump truck or 4–6 qts. per trailer. The amount varies somewhat according to the size of the container but can be determined readily by observation.

The dump truck or trailer coated with the treating emulsion is filled with hot-mix asphalt and emptied at the point of use with no adhesion to the walls of the container. The coating emulsions used in this method of treatment are completely biodegradable and meet environmental requirements. A like effect is observed when other equipment, tools, implements, etc. are coated with the treating emulsion, i.e. the equipment, tools, implements, etc. are easily released therefrom.

EXAMPLE 7

Coconut oil is admixed with sufficient sorbitol based emulsifier to produce a self emulsifying mixture. Then, the mixture is mixed with water in the proportion of about 2–3 oz. of the mixture per gallon of water to yield a treating emulsion for application to the walls of containers or equipment such as dump trucks and trailers. The treating emulsion is applied by spraying uniformly on the walls or a dump truck or trailer in the amount of 3–4 qts. per dump truck or 4–6 qts. per trailer. The amount varies somewhat according to the size of the container but can be determined readily by observation.

The dump truck or trailer coated with the treating emulsion is filled with hot-mix asphalt and emptied at the point of use with no adhesion to the walls of the container. The coating emulsions used in this method of treatment are completely biodegradable and meet environmental requirements. A like effect is observed when other equipment, tools, implements, etc. are coated with the treating emulsion, i.e. the equipment, tools, implements, etc. are easily released therefrom.

EXAMPLE 8

Palm kernel oil is admixed with sufficient sorbitol based emulsifier to produce a self emulsifying mixture. Then, the mixture is mixed with water in the proportion of about 2–3 oz. of the mixture per gallon of water to yield a treating emulsion for application to the walls of containers or equipment such as dump trucks and trailers. The treating emulsion is applied by spraying uniformly on the walls or a dump truck or trailer in the amount of 3–4 qts. per dump truck or 4–6 qts. per trailer. The amount varies somewhat according to the size of the container but can be determined readily by observation.

The dump truck or trailer coated with the treating emulsion is filled with hot-mix asphalt and emptied at the point of use with no adhesion to the walls of the container. The coating emulsions used in this method of treatment are completely biodegradable and meet environmental requirements. A like effect is observed when other equipment, tools, implements, etc. are coated with the treating emulsion, i.e. the equipment, tools, implements, etc. are easily released therefrom.

EXAMPLE 9

A mixture of cottonseed oil and soya oil is admixed with sufficient sorbitol based emulsifier to produce a self emulsifying mixture. Then, the mixture is mixed with water in the proportion of 1–5 oz. (preferably 2–3 oz.) of the mixture per gallon of water to yield a treating emulsion for application to the walls of containers or equipment such as dump trucks and trailers. The treating emulsion is applied by spraying uniformly on the walls or a dump truck or trailer in the amount of 3–4 qts. per dump truck or 4–6 qts. per trailer. The amount varies somewhat according to the size of the container but can be determined readily by observation.

The dump truck or trailer coated with the treating emulsion is filled with hot-mix asphalt and emptied at the point of use with no adhesion to the walls of the container. The coating emulsions used in this method of treatment are completely biodegradable and meet environmental requirements. A like effect is observed when other equipment, tools, implements, etc. are coated with the treating emulsion, i.e. the equipment, tools, implements, etc. are easily released therefrom.

While this invention has been shown fully and completely with special emphasis on certain preferred embodiments, it should be understood that within the scope of the appended claims the invention may be practiced otherwise than as specifically described herein.

We claim:

1. A method of transporting hot-mix asphalt in containers without adhesion to the walls thereof which comprises providing hot-mix asphalt to be transported, providing a container for transporting said hot-mix asphalt, providing a release agent consisting essentially of at least one vegetable oil dispersed in water with an emulsifier to yield a stable emulsion, said emulsion comprising 1–5 oz. vegetable oil and emulsifier per gallon of water.

applying said emulsion uniformly on the walls of said container as a film or coating, loading said emulsion-coated container with said hot-mix asphalt for transportation to a site of use, and unloading said hot-mix asphalt from said container leaving substantially no asphalt adhered to the walls thereof.

2. A method according to claim 1 in which said container is a dump truck or trailer for transporting hot-mix asphalt.

3. A method according to claim 2 in which said emulsion is applied at a rate of 3–4 qts. per dump truck or 4–6 pts. per trailer.

4. A method according to claim 1 in which said emulsion is applied to said container by spraying.

5. A method according to claim 1 in which said vegetable oil is cottonseed oil, soya oil, rate (canola) oil, peanut oil, corn oil, sunflower oil, palm oil, coconut oil, or palm kernel oil.

6. A method according to claim 1 in which said emulsifier is a sorbitol derivative.

7. A method according to claim 1 in which said vegetable oil is cottonseed oil, soya oil, rate (canola) oil, peanut oil, corn oil, sunflower oil, palm oil, coconut oil, or palm kernel oil, and said emulsifier is a sorbitol derivative.

8. A method according to claim 1 in which said vegetable oil is cottonseed oil, soya oil, rate (canola) oil, peanut oil, corn oil, sunflower oil, palm oil, coconut oil, or palm kernel oil, said emulsifier is a sorbitol derivative, and said emulsion comprises 1–5 oz. vegetable oil and emulsifier per gallon of water.

9. A method according to claim 1 in which said vegetable oil is cottonseed oil, soya oil, rate (canola) oil, peanut oil, corn oil, sunflower oil, palm oil, coconut oil, or palm kernel oil, said emulsifier is a sorbitol derivative, said emulsion comprises 1–5 oz. vegetable oil and emulsifier per gallon of water, and said emulsion is applied to said container by spraying.

10. A method according to claim 1 in which said container is a dump truck or trailer for transporting hot-mix asphalt, said vegetable oil is cottonseed oil, soya oil, rate (canola) oil, peanut oil, corn oil, sunflower oil, palm oil, coconut oil, or palm kernel oil, said emulsifier is a sorbitol derivative, said emulsion comprises 1–5 oz. vegetable oil and emulsifier per gallon of water, said emulsion is applied to said container by spraying, and said emulsion is applied at a rate of 3–4 qts. per dump truck or 4–6 qts. per trailer.

11. A method of releasing hot-mix asphalt from adhesion to the surface of equipment, tools, or implements which comprises providing hot-mix asphalt to be used, providing equipment, tools, or implements for use with said hot-mix asphalt, providing a release agent consisting essentially of at least one vegetable oil dispersed in water with an emulsifier to yield a stable emulsion, said emulsion comprising 1–5 oz. vegetable oil and emulsifier per gallon of water, applying said emulsion uniformly on the surfaces of said equipment, tools, or implements as a film or coating, using said equipment, tools, or implements with said hot-mix asphalt, and removing said hot-mix asphalt from said equipment, tools, or implements leaving substantially no asphalt adhered to the surfaces thereof.

12. A method according to claim 11 in which said emulsion is applied to said equipment, tools, implements or plants by spraying.

13. A method according to claim 11 in which said vegetable oil is cottonseed oil, soya oil, rate (canola) oil, peanut oil, corn oil, sunflower oil, palm oil, coconut oil, or palm kernel oil.

14. A method according to claim 11 in which said emulsifier is a sorbitol derivative.

* * * * *